United States Patent [19]

Takeda et al.

[11] 4,130,426

[45] Dec. 19, 1978

[54] HEAT DEVELOPABLE LIGHT-SENSITIVE DIAZOTYPE MATERIALS AND PROCESS OF USE

[75] Inventors: Keiji Takeda; Masayoshi Tsuboi, both of Asaka, Japan

[73] Assignee: Fuji Photo Film Co., Ltd., Minami-ashigara, Japan

[21] Appl. No.: 570,316

[22] Filed: Apr. 22, 1975

[30] Foreign Application Priority Data

Apr. 22, 1974 [JP] Japan ..... 49/45332

[51] Int. Cl.[2] ..... G03C 1/58; G03C 5/34

[52] U.S. Cl. ..... 96/49; 96/48 HD; 96/75; 96/90 R; 96/91 R

[58] Field of Search ..... 96/91 R, 75.49, 90 R

[56] References Cited

U.S. PATENT DOCUMENTS

| | | | |
|---|---|---|---|
| 2,531,091 | 11/1950 | Van Dormael | 96/49 |
| 2,542,849 | 2/1951 | Von Glahn et al. | 96/91 R |
| 2,547,843 | 4/1951 | Von Glahn et al. | 96/91 R |
| 2,552,355 | 5/1951 | Von Glahn et al. | 96/91 R |
| 2,884,326 | 4/1959 | Zemp | 96/90 R |
| 3,303,028 | 2/1967 | Aebi et al. | 96/91 R |
| 3,307,952 | 3/1967 | Aebi et al. | 96/91 R |
| 3,386,827 | 6/1968 | Aebi et al. | 96/91 R |
| 3,469,984 | 9/1969 | Bialczak | 96/91 R |
| 3,499,760 | 3/1970 | Amariti et al. | 96/91 R |
| 3,676,138 | 7/1972 | Poot et al. | 96/91 R |
| 3,676,140 | 7/1972 | Poot et al. | 96/91 R |
| 3,748,135 | 7/1973 | Singh | 96/90 R |
| 3,847,607 | 11/1974 | Endo et al. | 96/90 R |
| 3,856,531 | 12/1974 | Grisdale et al. | 96/90 R |
| 4,045,221 | 8/1977 | DoMinh | 96/48 HD |
| 4,075,019 | 2/1978 | DoMinh | 96/48 HD |

FOREIGN PATENT DOCUMENTS

| | | | |
|---|---|---|---|
| 839948 | 6/1960 | United Kingdom | 96/91 R |
| 868715 | 5/1961 | United Kingdom | 96/91 R |
| 1041022 | 9/1966 | United Kingdom | 96/75 |

*Primary Examiner*—Charles L. Bowers, Jr.

*Attorney, Agent, or Firm*—Sughrue, Rothwell, Mion, Zinn and Macpeak

[57] ABSTRACT

A heat developable light-sensitive material comprising at least one layer containing a diazonium salt and a metal-$\beta$-diketonate. If desired, these two essential components can be incorporated into different layers of the light-sensitive materials. The heat developable light-sensitive materials forms stable positive images upon exposure and heating.

10 Claims, No Drawings

HEAT DEVELOPABLE LIGHT-SENSITIVE DIAZOTYPE MATERIALS AND PROCESS OF USE

BACKGROUND OF THE INVENTION

1. Field of the Invention

The present invention relates to a heat developable light-sensitive material, and more particularly relates to a heat developable light-sensitive material employing a diazonium salt.

2. Description of the Prior Art

Various heat developable light-sensitive materials have hitherto been known. A typical example thereof is a heat developable light-sensitive material employing a diazonium salt, which is composed of a support having coated thereon a light-sensitive layer containing as essential components a light-sensitive diazonium salt, a coupler and a compound capable of generating an alkaline substance under heating, which compound is, hereinafter, referred to as an alkali-generating agent. When the light-sensitive layer of the material is exposed and then heated, desired photographic images can be formed.

In heat developable light-sensitive materials, there have been various problems that have not been easily solved. For example, since a diazonium salt, a coupler and an alkali-generating agent in the light-sensitive layer must be selected so that the reaction temperature of the diazonium salt and the coupler, and the thermal decomposition temperature of the alkali-generating agent are within a suitable range, it is troublesome to select the combination of the components; since the alkali-generating agent present in the light-sensitive layer is often gradually decomposed at room temperature (e.g., about 20° ~ 30° C.), it is very difficult to protect the properties of the light-sensitive materials from deterioration even if they are stored at room temperature; and since an alkaline substance such as ammonia gas is generated by developing the heat developable light-sensitive materials, ventilation of the room where the development is carried out is necessary and environmental pollution problems inside and out of the room occur.

SUMMARY OF THE INVENTION

An object of the invention is, therefore, to provide an improved heat developable light-sensitive material employing a diazonium salt which does not possess the problems that conventional heat developable light-sensitive materials employing a diazonium salt have always had.

The above object of the invention can be attained with a heat developable light-sensitive material comprising at least one layer containing a diazonium salt and a metal-$\beta$-diketonate, simultaneously or separately.

DETAILED DESCRIPTION OF THE INVENTION

The invention is based on the discovery that a diazonium salt and a metal-$\beta$-diketonate are reacted under heating to form a stable dye. When one or more layers containing these compounds are imagewise exposed prior to heating, the diazonium salt present in the exposed portions of the layer or layers is decomposed, whereby it does not react with the metal-$\beta$-diketonate even if followed by heating and so no dye images are formed in these portions. On the other hand, the diazonium salt in the unexposed portions of the layer or layers remains undecomposed, and reacts with the metal-$\beta$-diketonate under heating to form dye images. Therefore, dye images, as a whole, are formed on or in the light-sensitive layer or layers.

The metal-$\beta$-diketonate which is a very important component in the invention is a chelate compound which is produced from a metal ion and a $\beta$-diketone compound. The $\beta$-diketone compound used can be represented by the following general formula (I):

$$R^1-CO-\overset{\overset{\displaystyle R^3}{|}}{CH}-CO-R^2 \qquad \text{(I)}$$

In the above formula (I), $R^1$, $R^2$ and $R^3$ each represents an aliphatic group (e.g., for example, an alkyl group, preferably those alkyl groups having 1 to 10 carbon atoms such as a methyl, ethyl, propyl or butyl group (including the isomers of these groups); a haloalkyl group such as a trifluoromethyl, tribromomethyl or trichloromethyl group; ethylenically or acetylenically unsaturated groups which may be unsubstituted or substituted with a halogen atom, etc., in which at least one methylene group is directly bonded to the CO group such as an allyl group, a 4-butenyl group, a 3-pentenyl group; an alkyl group containing —O—, —S—, —CO—, —CS—, —NH— bonding in the alkyl chain in which at least one methylene group is directly bonded to the CO group such as $-CH_2OH$, $-CH_2OCH_3$, $-CH_2CH_2SCH_3$, $$-CH_2-\overset{\overset{\displaystyle O}{\|}}{C}-CH_3,\quad -CH_2-\overset{\overset{\displaystyle S}{\|}}{C}-CH_3,$$

$-CH_2CH_2-OH$, $-CH_2CH_2OCH_3$, $-CH_2CH_2OCH_2CH_3$, $-CH_2-NH-CH_3$, $-CH_2CH_2NHCH_2CH_3$, etc.); an aryl group (such as a phenyl group or a substituted phenyl group having a substituent selected from alkyl groups, preferably those alkyl groups containing 1 to 5 carbon atoms, such as a methyl or ethyl group, halogen atoms such as an iodine, bromine, chlorine or fluorine atom, haloalkyl groups having 1 to 5 carbon atoms in the alkyl moiety, hydroxyl groups, hydroxyalkyl groups having 1 to 5 carbon atoms in the alkyl moiety, alkoxy groups having 1 to 5 carbon atoms in the alkoxy moiety such as a methoxy or ethoxy group, alkoxyalkyl groups having 1 to 5 carbon atoms in the alkyl moiety and in the alkoxy moiety, a cyano group, an acetyl group, aralkyl groups having 1 to 5 carbon atoms in the alkyl moiety such as a benzyl or phenethyl group, aryloxy groups, amino groups, alkylamino groups having 1 to 5 carbon atoms in the alkyl moiety or moieties, and a nitro group; naphthyl; anthryl; and the like) or a heterocyclic residue (such as a furan or thiophene group which may optionally be substituted, e.g., with an alkyl group having 1 to 5 carbon atoms such as a methyl, ethyl, or propyl group, a halogen atom such as a fluorine, chlorine, bromine or iodine atom, an alkoxy group having 1 to 5 carbon atoms in the alkoxy moiety, etc.). $R^3$ can also be a hydrogen atom.

The metal $\beta$-diketonate compounds formed from these $\beta$-diketone compounds and metal ions ($M^{m+}$) are expressed by the following general formula (II):

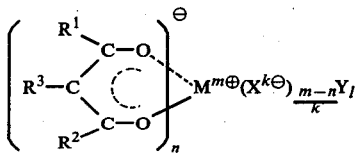

(II)

wherein M is a metal ion or a complex metal ion capable of forming a chelate compound with a β-diketone and m is an integer corresponding to the positive charge of the metal ion or the complex metal ion, X is an anion, Y is a neutral ligand, k is an integer of 1 to (m-n), n is an integer of 1 to m, and l is an integer of 0 to 3.

The method for preparing these metal-β-diketonates is described in detail, for example, in J. T. Adams and C. R. Hauser, *J. Am. Chem. Soc.*, Vol. 66, page 1220, (1944). The metal-β-diketonates used in this invention can be prepared substantially in accordance with this method.

Of the above metal-β-diketonate compounds of the general formula (II), acetylacetonates (i.e., in which $R^1$ and $R^2$ are methyl groups and $R^3$ is a hydrogen atom) are compounds which are especially preferably used in the present invention. Acetylacetone (to be abbreviated "acac" hereinafter) is known to form a stable or comparatively stable chelate with almost all metals. Specific examples of acetylacetonato-metal chelate compounds include bis-compounds such as $Co(acac)_2$, $Zn(acac)_2$, $U(IV)O_2(acac)_2$, $Cd(acac)_2$, $Ca(II)(acac)_2(OH_2)_2$, $Sr(acac)_2$, $Ba(II)(acac)_2(OH_2)_2$, $Co(II)(acac)_2(NH_3)_2$, $Fe(acac)_2$, $Hg(acac)_2$, $Cu(acac)_2$, $Ni(acac)_2$, $Pt(acac)_2$, $Pd(acac)_2$, $Be(acac)_2$, $B(III)(acac)_2X$, $Mg(acac)_2$,$Mn(acac)$ $Mo(acac)_2$, $SnCl_2(acac)_2$, $VO(acac)_2$, $Mo(IV)O_2(acac)_2$, $TiO(acac)_2$ and $Pb(acac)_2$; tris-compounds such as $Al(acac)_3$, $In(acac)_3$,$Ga(acac)_3$ $Cr(acac)_3$, $[Si(acac)_3]X$, $[Ge(acac)_3]X$, $Co(acac)_3$, $Na[Co(II)(acac)_3]$, $Sm(acac)_3$, $Sc(acac)_3$, $Ce(acac)_3$, $[Ti(acac)_3]_3$, $[Ti(acac)_2{\cdot}TiCl_6][FeCl_4]$, $[Ti(acac)_3]_2[PtCl_6]$, $Fe(acac)_3$, $Nd(acac)_3$, $V(acac)_3$, $Mn(acac)_3$, $La(acac)_3$, $Ru(acac)_3$ and $Rh(acac)_3$; and tetrakis-compounds such as $U(acac)_4$, $Zr(acac)_4$, $Ce(acac)_4$, $Th(acac)_4$, and $Hf(acac)_4$. In the above examples, X represents $Cl^-$, $I^-$, $I_3^-$, $ZnCl_3^-$, $SnCl_6^-$, $SnCl_5^-$, $FeCl_4^-$, $AuCl_4^-$, $CuCl_2^-$, $CuBr_2^-$, $Cu_2Br_3^-$, or $CuBr_3^-$, etc.

Chelate compounds formed from β-diketones such as

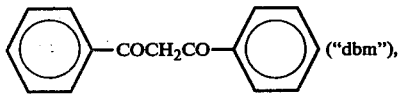

("dbm"),

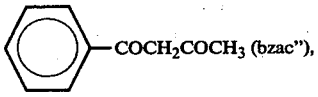

("bzac"), $CF_3COCH_2COCH_3$ ("tfpd"), $CF_3COCH_2COCF_3$ ("hfpd"), $CH_3COCH_2CO{-}C(CH_3)_3$,

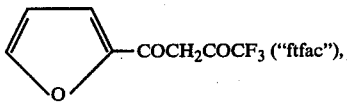

("ftfac"),

-continued

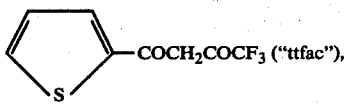

("ttfac"),

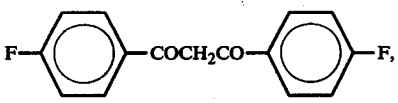

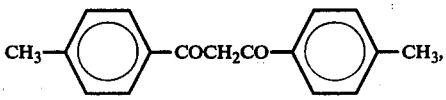

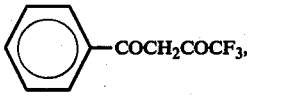

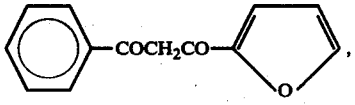

$CF_3COCH_2CO{-}C_5H_{11}$,

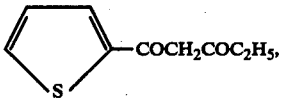

$CH_3COCH_2COCH_2CH{=}CH_2$, $CF_3COCH_2COCH_2CH_2OCH_3$, etc., and various metal atoms can also be used conveniently in the present invention, e.g., where "acac" in the above-described specific examples is replaced by "dbm", "bzac", "hfpd", "ttfac", etc.

Many metal elements can be used as the metal atoms for forming the chelate and Mo, Ti, Sn, Cr, Zr, Al, W, U and Pb are preferably used.

Typical and preferred examples of these metal-β-diketonate compounds are $MoO_2(acac)_2$, $MoO_2(tfpd)_2$, $MoO_2(hfpd)_2$, $MoO_2(bzac)_2$, $MoO_2(dbm)_2$, $MoO_2(ftfac)_2$, $Mo(acac)_2$, $Mo(tfpd)_2$, $Mo(hfpd)_2$, $Mo(bzac)_2$, $Mo(dbm)_2$, $[Ti(acac)_3]_2{\cdot}TiCl_6$, $[Ti(tfpd)_3]_2{\cdot}TiCl_6$, $[Ti(bzac)_3]_2{\cdot}TiCl_6$, $[Ti(ftfac)_3]_2{\cdot}TiCl_6$, $SnCl_2(acac)_2$, $SnCl_2(tfpd)_2$, $SnCl_2(bzac)_2$, $SnCl_2(ftfac)_2$, $Cr(acac)_3$, $Cr(dbm)_3$, $Zr(acac)_4$, $Zr(dbm)_4$, $Al(acac)_3$, $Al(dbm)_3$, $W(acac)_2$, $UO_2(acac)_2$ and $Pb(acac)_2$, in which as described above "acac" means acetylacetone, "tfpd" means 1,1,1-trifluoro-2,4-pentanedione, "hfpd" means 1,1,1,5,5,5-hexafluoro-2,4-pentanedione, "bzac" means benzoylacetone, "dbm" means dibenzoylmethane, "ftfac" means 2-furoyltrifluoroacetone and "ttfac" means 2-thenoyltrifluoroacetone which are ligands. At least one of these metal-β-diketonates can be used in the invention, that is, a specific one of them or a suitable combination of them can be used.

All diazonium salts which have been utilized in conventional diazo photographic light-sensitive materials can be preferably employed as diazonium salts used in the invention together with the metal-β-diketonates. These diazonium salts are disclosed in detail in Jaromir Kosar, *Light-Sensitive Systems: Chemistry and Application of Non-Silver Halide Photographic Processes.*

Typical examples of diazonium salts are as follows:

In the following formulae, $X^1$ is an anion such as $Cl^-$, $Br^-$, $SO_4^-$, $NO_3^-$, $ClO_4^-$ or $BF_4^-$, to which $ZnCl_2$, $CdCl_2$ or $SnCl_4$ may be attached.

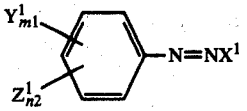

(III)

wherein $Y^1$ and $Z^1$ each is an alkoxy group having 1 to 5 carbon atoms (e.g., methoxy, ethoxy, propoxy, butoxy, isopentyloxy, etc.), a halogen atom (e.g., fluorine, chlorine, bromine and iodine) or an aryl group (e.g., phenyl, alkoxy phenyl in which the alkoxy moiety has 1 to 5 carbon atoms, halophenyl in which the halogen atoms are as described above), $m_1$ and $n_1$ each is 0 or a positive integer of 1 to 5. Typical examples of compounds represented by the above formula (III) include 4-ethoxybenzenediazonium chloride and 2,5-dimethoxybenzenediazonium chloride.

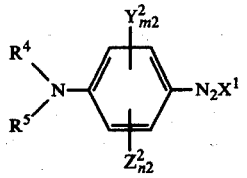

(IV)

wherein $R^4$ and $R^5$ each is an alkyl group having 1 to 5 carbon atoms (e.g., methyl, ethyl, n-propyl, isopropyl, n-butyl, isobutyl, isopentyl, 2-methylbutyl, etc.), an alkoxy group having 1 to 5 carbon atoms (e.g., methoxy, ethoxy, propoxy, butoxy, isopentyloxy, etc.), hydroxyalkyl group having 1 to 5 carbon atoms (e.g., 2-hydroxyethyl, 3-hydroxypropyl, 4-hydroxypropyl, etc.), a benzyl group, a substituted benzyl group (e.g., substituted with alkyl groups having 1 to 5 carbon atoms such as methyl, ethyl, n-propyl, isopropyl, n-butyl, iso-butyl, isopentyl, 2-methylbutyl, etc., or halogen atoms such as fluorine, chlorine, bromine and iodine), a phenyl group, a substituted phenyl group, (e.g., substituted with alkyl groups having 1 to 5 carbon atoms such as methyl, ethyl, n-propyl, isopropyl, n-butyl, iso-butyl, isopentyl, 2-methylbutyl, etc., or halogen atoms such as fluorine, chlorine, bromine and iodine) or a hydrogen atom, $Y^2$ and $Z^2$ each is a halogen atom (e.g., as described above for $Y^1$ and $Z^1$), an alkyl group having 1 to 5 carbon atoms (e.g., as described above for $R^4$ and $R^5$), a carboxyl group, an alkoxy group having 1 to 5 carbon atoms (e.g., as described above for $R^4$ and $R^5$), a nitro group, or an acetoxy group, and $m_2$ and $n_2$ each is 0 or a positive integer of 1 to 4. Typical examples of compounds represented by the above formula (IV) include 4-N,N-dimethylaminobenzenediazonium chloride, 3-chloro-4-N,N-dimethylaminobenzenediazonium chloride, 4-N,N-diethylaminobenzenediazonium chloride, 1,6-dieth o xy-4-N,N-diethylaminobenzenediazonium chloride, 4-N-ethyl-N-hydroxyethyl-aminobenzenediazonium chloride, 4-N,N-diethoxyaminobenzenediazonium chloride, 4-phenylaminobenzenediazonium chloride and 4-N-(p-methoxyphenyl)aminobenzenediazonium chloride.

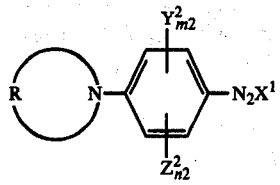

(V)

wherein R is $—CH_2CH_2OCH_2CH_2—$ or $—CH_2OCH_2CH_2—$, $Y^2$, $Z^2$, $m_2$ and $n_2$ have the same meanings as in the formula (IV). Typical examples of compounds represented by the above formula (V) include 4-morpholinobenzenediazonium chloride, 2,5-diethoxy-4-morpholinodiazonium chloride and 4-oxazolidinobenzenediazonium chloride.

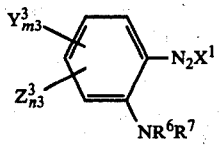

(VI)

wherein $R^6$ and $R^7$ each is a hydrogen atom or an alkyl group having 1 to 5 carbon atoms (e.g., as described for $R^4$ and $R^5$), $Y^3$ and $Z^3$ each is an alkyl group having 1 to 5 carbon atoms (e.g., as described for $Y^2$ and $Z^2$), an alkoxy group having 1 to 5 carbon atoms (e.g., as described for $R^4$ and $R^5$), a carboxy group, an acetoxy group or an aryl group (e.g., as described for $Y^1$ and $Z^1$), and $m_3$ and $n_3$ each is 0 or an integer of 1 to 4. Typical examples of compounds represented by the above formula (VI) include 4,5-dimethyl-2-dimethylaminobenzenediazonium chloride.

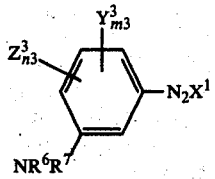

(VII)

wherein $R^6$, $R^7$, $Y^3$, $Z^3$, $m_3$ and $n_3$ have the same meanings as in the above formula (VI). Typical examples of compounds represented by the above formula (VII) include 3-dimethylaminobenzenediazonium chloride.

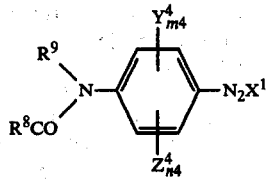

(VIII)

wherein $R^8$ is an alkyl group having 1 to 5 carbon atoms (e.g., as described for $R^4$ and $R^5$), an alkoxy group having 1 to 5 carbon atoms (e.g., as described for $R^4$ and $R^5$), or an aryl group (e.g., as described for $Y^1$ and $Z^1$), $R^9$ is a hydrogen atom or an alkyl group having 1 to 5 carbon atoms (e.g., as described for $R^4$ and $R^5$), $Y^4$ and $Z^4$ each is a halogen atom (e.g., as described for $Y^2$ and $Z^2$), an alkyl group having 1 to 5 carbon atoms (e.g., as described for $Y^2$ and $Z^2$) or an alkoxy group having 1 to 5 carbon atoms (e.g., as described for $Y^2$ and $Z^2$), and $m_4$ and $n_4$ each is 0 or an integer of 1 to 4. Typical examples of compounds represented by the above formula (VIII) include 2,5-diethoxybenzoylaminobenzenediazonium chloride and 2,5-dibutoxybenzoylaminobenzenediazonium chloride.

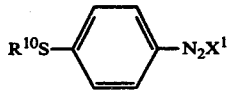

(IX)

wherein $R^{10}$ is an alkyl group (e.g., as described for $R^4$ and $R^5$) or an aryl group (e.g., as described for $R^4$ and $R^5$). Typical examples of compounds represented by the above formula (IX) include 4-ethylmercapto-2,5-diethoxybenzenediazonium chloride, 4-tolylmercapto-2,5-diethoxybenzenediazonium chloride and 4-benzylmercapto-2,5-dimethoxybenzenediazonium chloride.

The typical examples of diazonium salts useful for the present invention are described above, and the diazonium salts can be used individually or in combination similar to the metal-β-diketonate and can be selected taking into consideration ready availability and the desired color hue of the images obtained.

These diazonium salts and metal-β-diketonates can be dissolved or dispersed in a solvent (e.g., in an amount of about 0.1 to 20% by weight, preferably 1 to 10% by weight) and then coated on a support, and each of them can be dissolved or dispersed in a solvent and then coated on a support in a superimposed relationship. In this case, a binder can be dissolved or dispersed in the solvent. By using a binder, each component of the invention can be present in separate layers. If a layer formed is sufficiently self-supporting due to the film-forming property of the binder, it is not necessary for a support to be employed.

It is necessary that the solvent employed not react with each component to be dissolved or dispersed therein and it is more preferred to employ a polar solvent in which both the diazonium salt and the metal-β-diketonate can be dissolved. Further, more preferred solvents have a boiling point of about 40° to 200° C. to facilitate drying of the coating layer at a moderate speed. Specific examples of solvents employed for producing heat-developable light-sensitive materials of the invention are N,N-dimethylformamide; dimethylsulfoxide; aliphatic ketones such as acetone or methyl ethyl ketone; monohydric alcohols having not more than 7 carbon atoms such as methanol or ethanol; dihydric alcohols having not more than 5 carbon atoms such as ethylene glycol; cyclic ethers such as tetrahydrofuran or dioxane; esters such as ethyl acetate or butyl acetate; ethers such as ethylene glycol monomethyl ether; halogenated hydrocarbons such as chloroform, carbon tetrachloride, methylene chloride or trichloroethylene, aromatic hydrocarbons such as benzene, toluene or xylene, halogenated aromatic hydrocarbons, and water.

The binder can be selected from various kinds of synthetic, semi-synthetic and natural high molecular weight substances. It is preferred that the binder be stable on storage for a long time, be soluble in a solvent, and have a film-forming property. The molecular weight of the binder is generally about 1,000 to 500,000. Specific examples of binders are synthetic high molecular weight materials such as polyvinyl chloride, polyvinylidene chloride, vinylidene chloride-acrylonitrile copolymer in which the molar ratio of acrylonitrile is about 50% or less, polyvinyl acetate, polyvinyl formal, polyvinyl butyral, polystyrene, polymethyl methacrylate, polyvinyl alcohol, polyvinyl pyrrolidone and condensation type polymers (e.g., nylons or polyesters), semi-synthetic high molecular weight materials such as acetyl cellulose, and natural high molecular weight materials such as gelatin.

The heat-developable light-sensitive materials of the invention can be prepared, for example, using one of the following methods:

(1) a diazonium salt and a metal-β-diketonate are dissolved or dispersed in a solvent, and then the solution or dispersion is coated on a support and dried.

(2) A diazonium salt and a metal-β-diketonate each is dissolved or dispersed in a solvent, respectively, and one solution or dispersion is coated on a support and dried, and then the other solution or dispersion is coated on the layer and dried. This coating operation can be carried out two or more times.

(3) The same method as described for the above two methods can be carried out in the presence of a binder.

(4) Using the above method (3), a coating composition is coated on a support and after a coating layer or layers are set, the layer or layers are stripped from the support to obtain light-sensitive materials of the invention.

In these embodiments of the invention, the amounts of the components employed are as follows:

In methods (1) to (3), the amount of the metal-β-diketonate is about 30 to 300 parts by weight based on 100 parts by weight of the diazonium salt. In method (3), the amount of binders is about 100 to 5,000 parts by weight based on 100 parts of the diazonium salt. If the amount of binders is less than this amount, the formed light-sensitive layer cracks and becomes opaque, and if the amount of binders is more than this amount, the color formation is insufficient because the amounts of the diazonium salt and the metal-β-diketonate are relatively less than the amount of the binder and because the reaction of both components is not effectively carried out. Further, in each case, the weight ratio of each component to be dissolved or dispersed in a solvent is preferably decided so that the total amounts of components to the solvent becomes about 1 to 50 wt%, whereby the coating operations can be easily conducted and a uniform light-sensitive layer can be obtained.

The light-sensitive coating composition in the above embodiments can be coated on a support or a temporary support using any coating method employed in the photographic industry, for example, methods utilizing a coating rod, a roll coating apparatus, a curtain coating apparatus or a dip coating apparatus. The coating layer can be dried using any conventional method. The thickness of the dried coating layer containing the binder is about 0.5 to 500 microns, preferably 1 to 50 microns. In order to obtain the coating thickness of the dried coating layer, the amount of binder in the coating composition, the concentration of the coating composition or the coating conditions can be adjusted. The drying operation of the coating layer can be preferably carried out at a temperature of about 70° C. or less taking into consideration the reaction temperature between the diazonium salt and the metal-β-diketonate or of the decomposition temperature of the diazonium salt. A suitable thickness of the layer where a binder is not used can range from about 0.1 to 5, preferably 0.5 to 2 μ.

The support should have sufficient strength to support a light-sensitive layer formed thereon and be adhesive to the light-sensitive layer. From the standpoint of handling the heat-developable light-sensitive materials, preferably the support is a flexible film or sheet. The support can be transparent or opaque, and can be glossy or non-glossy. Where a support has insufficient adhesive property to the light-sensitive layer, a subsidiary layer, a so-called subbing layer which increases the adhesive property between the support and the light-sensitive layer, can be provided therebetween as in the production of the other light-sensitive materials. Typical examples of supports are transparent high molecular weight films such as polyesters represented by polyethylene terephthalate, polyamides, polyimides, polyvinyl chloride, polystyrene, polycarbonate or cellulose acetate; opaque materials such as cellulose fiber, paper, wood or synthetic paper; and inorganic materials such as metal plates or glass plates.

A method for forming images using the heat-developable light-sensitive material of the invention comprises imagewise exposing (e.g., for about 0.1 to 200, preferably 1 to 60, seconds) the light-sensitive material and then heating the material to a suitable temperature ranging from about 50° to 200° C. The light-sensitive layer of the light-sensitive material is faintly colored by the diazonium salt and the metal-$\beta$-diketonate prior to the exposure, and when the material is exposed, the faint color in the exposed portions of the layer disappears or fades, whereby the faint color in the unexposed portions of the layer often imagewise remains. When the light-sensitive layer is then heated, the exposed portions thereof do not change in color and the unexposed portions thereof become colored, whereby positive images to the original are formed. The color of thus-formed images can be varied by the kinds of diazonium salts or metal-$\beta$-diketonates employed but is generally blue, violet, red violet, pink or light brown in many cases.

As light sources for exposure of the light-sensitive materials, a xenon lamp, a mercury lamp, a tungsten lamp and a carbon arc lamp can be usually employed. In the invention, ultraviolet light or visible light generated from the light sources can be utilized for exposure, but X-rays or gamma rays having shorter wavelengths than that of the above light can be utilized. The kind of light source can be selected based on the spectral sensitivity of the light-sensitive materials.

The temperature for heating the exposed light-sensitive materials on development depends on the reaction rate between the diazonium salt and the metal-$\beta$-diketonate and on the softness of the binder, that is, the mobility of solute molecules in the binder. The temperature is generally about 50° to 200° C., preferably 80° to 150° C. The time necessary for heating the light-sensitive materials is generally about 3 seconds to 3 minutes, preferably 10 seconds to 1 minute. The heating operation can be conducted by contacting the light-sensitive materials with a uniformly heated plate or by exposing the material to heat from an infrared lamp. The light-sensitive materials of the invention can be, otherwise, developed using other heating methods.

The invention will be explained in greater detail by reference to the following examples. Unless otherwise indicated, all parts, percentages, ratios and the like are by weight.

EXAMPLE 1

In 2.5 ml of N,N-dimethylformamide (solvent), 20 mg of p-N,N-diethylaminobenzene diazonium chloride.zinc chloride, 50 mg of $MoO_2(acac)_2$ and 250 mg of polyvinyl formal (binder) were dissolved in the dark, the thus-prepared solution was coated on a polyethylene terephthalate film having a thickness of 100 microns using a coating rod and then the coating layer was dried at 60° C. over a period of about 1 hour. The thus-formed light-sensitive layer had a dry thickness of about 10 microns.

On the light-sensitive layer of the thus-prepared light-sensitive material, an optical wedge was superimposed and the light-sensitive material was exposed from the side of the wedge to a 500 watt xenon lamp (light source) at distance of 10 cm from the wedge for 1 minute, whereby the exposed portions of the light-sensitive layer having a faint yellow color were discolored and positive images corresponding to the images of the optical wedge were formed. Then, the light sensitive material was contacted with a plate heated to 150° C. for 30 seconds, whereby the unexposed portions which had not been changed in color by exposure were colored a dark red violet. That is, positive type color images having high contrast were obtained.

EXAMPLE 2

In 3 ml of N,N-dimethylformamide, 30 mg of p-morpholinobenzene diazonium tetrafluoroborate, 30 mg of $Mo(bzac)_2$ and 300 mg of polyvinyl butyral were dissolved in the dark. The same procedure as in Example 1 was repeated using the solution to obtain violet color images in the unexposed portions which were positive type images to the optical step wedge.

EXAMPLE 3

In 2.5 ml of N,N-dimethylformamide, 20 mg of p-diethylaminobenzene diazonium chloride·zinc chloride, 40 mg of $[Ti(acac)_3]_2 \cdot TiCl_6$ and 300 mg of polyvinyl formal were dissolved in the dark. The same procedure as in Example 1 was repeated using the thus-prepared solution to obtain pink color images in the unexposed portions which were positive type images to the optical wedge.

EXAMPLE 4

In 2.5 ml of N,N-dimethylformamide, 20 mg of p-N-ethyl-N-hydroxyethylaminobenzene diazonium chloride·zinc chloride, 50 mg of $SnCl_2(acac)_2$ and 250 mg of polyvinyl formal were dissolved in the dark. The same procedure as in Example 1 was repeated using the thus-prepared solution to obtain light brown color images in the unexposed portions which were positive type images to the optical wedge.

EXAMPLE 5

In 2 ml of chloroform, 20 mg of p-N,N-dimethylaminobenzene diazonium chloride zinc chloride, 20 mg of $MoO_2(acac)_2$ and 400 mg of vinylidene chloride-acrylonitrile copolymer (copolymerization molar ratio: 85:15) were dissolved in the dark. The same procedure as in Example 1 was repeated using the thus-prepared solution to obtain blue color images in the unexposed portions which were positive type images to the optical wedge and to obtain vesicular images called "Kalver type photographic images" in the exposed portions which were bubbles in the copolymer used as the binder. The bubbles were generated by the photodecomposition of the diazonium salt.

EXAMPLE 6

In 1 ml of tetrahydrofuran, 20 mg of p-oxazolidinobenzene diazonium chloride·zinc chloride and 30 mg of $Cr(acac)_3$ were dissolved to prepare a coating solution which was then extruded on an art paper having an area of 100 $cm^2$ and allowed to stand for 2 hours at room temperature to dry the layer. The thus-prepared light-sensitive paper was imagewise exposed in the same manner as in Example 1, whereby the exposed portions thereof became colorless while it was a faint yellow color prior to the exposure. Thereafter, the light-sensitive paper was closely contacted with a plate heated to 130° C. for 30 seconds to obtain orange color images in the unexposed portions which were positive type images to the optical wedge. In this case, the exposed portions were not colored.

As illustrated above, many advantages can be obtained according to the thermally developable light-sensitive materials of the invention, that is, the storability of the materials can be remarkably improved because an alkaline color former is not present in the materials; environmental pollution problems do not occur because the materials do not generate an alkali; a fixing operation is unnecessary because development and image stabilization can be simultaneously carried out by simply heating after exposure; and positive type images having a desired color can be obtained by selecting the kinds of the diazonium salt and the metal-β-diketonate.

The heat-developable light-sensitive materials of the invention can be utilized in combination with some techniques carried out with other photographic materials. For example, if photographic elements in the diazonium vesicular photographic methods are introduced into the heat-developable light-sensitive materials of the invention, the diazonium vesicular photographic images obtained can be positive color images and therefore such photographic materials can be applied to wider ranges. If elements in conventional diazo type presensitized printing plates are introduced into the heat-developable light-sensitive materials of the invention, the printing images formed can be observed before the inking operation thereon because print-out images having visible densities are formed by simply heating the heat-developable light-sensitive materials for a short time, after exposure, with an infrared ray or hot air stream.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon at least one layer with a light-sensitive diazonium salt; and a metal-β-diketonate chelate compound represented by the following general formula (II):

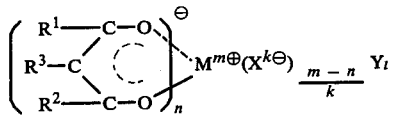

(II)

wherein $R^1$, $R^2$ and $R^3$ represent an aliphatic group or an aryl group and $R^3$ can also be a hydrogen atom; M is a metal ion or a complex metal ion capable of forming a chelate compound with a β-diketone and m is an integer corresponding to the positive charge of the metal ion or the complex metal ion; X is an anion; Y is a neutral ligand selected from the group consisting of ammonia and water; k is an integer of 1 to (m-n); n is an integer of 1 to m; m is an integer of from 2 to 4; and l is an integer of 0 to 3 with the proviso that when M is a Co ion, the Co ion is the Co++ ion;

said diazonium salt and said metal-β-diketonate chelate compound being contained in the same layer or different layers, respectively, and being present in sufficient quantity that a positive colored image to an original is produced upon imagewise exposure and heat development.

2. The heat-developable light-sensitive material of claim 1, wherein said at least one layer contains a binder.

3. The heat-developable light-sensitive material of claim 2, wherein the amount of the metal-β-diketonate chelate compound is about 30 to 300 parts by weight per 100 parts by weight of the diazonium salt and the amount of the binder is about 100 to 5,000 parts by weight per 100 parts by weight of the diazonium salt.

4. The heat-developable light-sensitive material of claim 1, wherein said metal-β-diketonate chelate compound is $MoO_2(acac)_2$, $MoO_2(tfpd)_2$, $MoO_2(hfpd)_2$, $MoO_2(bzac)_2$, $MoO_2(dbm)_2$, $Mo(acac)_2$, $Mo(tfpd)_2$, $Mo(hfpd)_2$, $Mo(bzac)_2$, $Mo(dbm)_2$, $[Ti(acac)_3]_2 \cdot TiCl_6$, $[Ti(tfpd)_3]_2 \cdot TiCl_6$, $[Ti(bzac)_3]_2 \cdot TiCl_6$, $SnCl_2(acac)_2$, $SnCl_2(tfpd)_2$, $SnCl_2(bzac)_2$, $Cr(acac)_3$, $Cr(dbm)_3$, $Zr(acac)_4$, $Zr(dbm)_4$, $Al(acac)_3$, $Al(dbm)_3$, $W(acac)_2$, $UO_2(acac)_2$ and $Pd(acac)_2$, in which "acac" means acetylacetone, "tfpd" means 1,1,1-trifluoro-2,4-pentanedione, "hfpd" means 1,1,1,5,5,5-hexafluoro-2,4-pentane-dione, "bzac" means benzoylacetone and "dbm" means dibenzoylmethane.

5. The heat-developable light-sensitive material of claim 1, wherein said diazonium salt is a compound selected from the group of compounds represented by the general formula (III) to (IX):

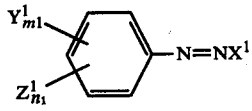

(III)

wherein $Y^1$ and $Z^1$ each is an alkoxy group having 1 to 5 carbon atoms, a halogen atom or an aryl group; $m_1$ and $n_1$ each is 0 or a positive integer of 1 to 5;

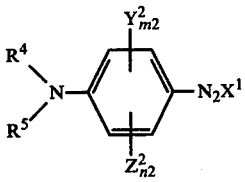

(IV)

wherein $R^4$ and $R^5$ each is an alkyl group having 1 to 5 carbon atoms, an alkoxy group having 1 to 5 carbon atoms, a hydroxyalkyl group having 1 to 5 carbon atoms, a benzyl group, a phenyl group, or a hydrogen atom; $Y^2$ and $Z^2$ each is a halogen atom, an alkyl group having 1 to 5 carbon atoms, a carboxyl group, an alkoxy group having 1 to 5 carbon atoms, a nitro group, or an acetoxy group; and $m_2$ and $n_2$ each is 0 or a positive integer of 1 to 4;

(V)

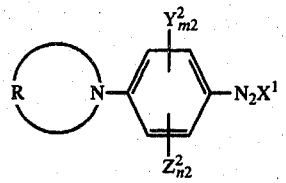

wherein R is $-CH_2CH_2OCH_2CH_2-$ or $-CH_2OCH_2CH_2-$; $Y^2$, $Z^2$, $m_2$ and $n_2$ each has the same meanings as in the formula (IV);

(VI)

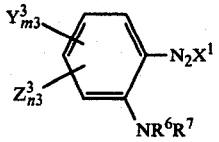

wherein $R^6$ and $R^7$ each is a hydrogen atom or an alkyl group having 1 to 5 carbon atoms; $Y^3$ and $Z^3$ each is an alkyl group having 1 to 5 carbon atoms, an alkoxy group having 1 to 5 carbon atoms, a carboxy group, an acetoxy group or an aryl group; and $m_3$ and $n_3$ each is 0 or an integer of 1 to 4;

(VII)

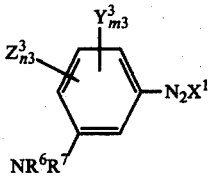

wherein $R_6$, $R_7$, $Y_3$, $Z_3$, $m_3$ and $n_3$ each has the same meanings as in the above formula (VI);

(VIII)

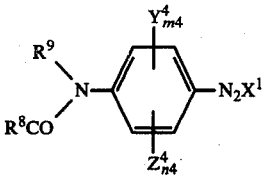

wherein $R^8$ is an alkyl group having 1 to 5 carbon atoms, an alkoxy group having 1 to 5 carbon atoms or an aryl group; $R^9$ is a hydrogen atom or an alkyl group having 1 to 5 carbon atoms; $Y^4$ and $Z^4$ each is a halogen atom, an alkyl group having 1 to 5 carbon atoms or an alkoxy group having 1 to 5 carbon atoms; and $m_4$ and $n_4$ is 0 or an integer of 1 to 4; and (IX)

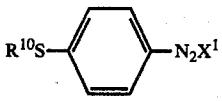

wherein $R^{10}$ is an alkyl group or an aryl group; wherein $X^1$ in each of the above formulas (III) to (IX) is an anion.

6. The heat-developable light-sensitive material of claim 5, wherein said diazonium salt is 4-ethoxybenzenediazonium chloride, 2,5-dimethoxybenzenediazonium chloride, 4-N,N-dimethylaminobenzenediazonium chloride, 3-chloro-4-N,N-dimethylaminobenzenediazonium chloride, 4-N,N-diethylaminobenzenediazonium chloride, 1,6-diethoxy-4-N,N-diethylaminobenzenediazonium chloride, 4-N-ethyl-N-hydroxyethylaminobenzenediazonium chloride, 4-N,N-diethoxyaminobenzenediazonium chloride, 4-phenylaminobenzenediazonium chloride, 4-N-(p-methoxyphenyl)-aminobenzenediazonium chloride, 4-morpholinobenzenediazonium chloride, 2,5-diethoxy-4-morpholinodiazonium chloride, 4-oxazolidinobenzenediazonium chloride, 4,5-dimethyl-2-dimethylaminobenzenediazonium chloride, 3-dimethylaminobenzenediazonium chloride, 2,5-diethoxybenzoylaminobenzenediazonium chloride, 2,5-dibutoxybenzoylaminobenzenediazonium chloride, 4-ethylmercapto-2,5-diethoxybenzenediazonium chloride, 4-tolylmercapto-2,5-diethoxybenzenediazonium chloride or 4-benzylmercapto-2,5-dimethoxybenzenediazonium chloride.

7. The heat-developable light-sensitive material of claim 1, wherein the amount of the metal-$\beta$-diketonate chelate compound is about 30 to 300 parts by weight per 100 parts by weight of the diazonium salt.

8. A method of forming an image comprising imagewise exposing the heat-developable light-sensitive material of claim 1 to radiation to which the light-sensitive diazonium salt is sensitive and heating the exposed heat-developable light-sensitive material at a temperature of about 50° C. to about 200° C.

9. The method of claim 8, wherein said imagewise exposing is to visible light, ultraviolet light, X-rays or gamma rays to which said light-sensitive diazonium salt is sensitive.

10. The method of claim 8, wherein following said image-wise exposure the diazonium salt present in exposed areas is decomposed, whereby it does not react with the metal $\beta$-diketonate upon said heating, whereas diazonium salt in unexposed areas remains undecomposed and reacts with the metal $\beta$-diketonate under heating to form a dye image.

* * * * *